US011646496B2

(12) United States Patent
Kim et al.

(10) Patent No.: US 11,646,496 B2
(45) Date of Patent: *May 9, 2023

(54) ANTENNA APPARATUS AND ANTENNA MODULE

(71) Applicant: SAMSUNG ELECTRO-MECHANICS CO., LTD., Suwon-si (KR)

(72) Inventors: Nam Ki Kim, Suwon-si (KR); Ju Hyoung Park, Suwon-si (KR); Jeong Ki Ryoo, Suwon-si (KR); Myeong Woo Han, Suwon-si (KR); Dae Ki Lim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 11 days.

This patent is subject to a terminal disclaimer.

(21) Appl. No.: 17/101,709

(22) Filed: Nov. 23, 2020

(65) Prior Publication Data

US 2021/0075114 A1 Mar. 11, 2021

Related U.S. Application Data

(63) Continuation of application No. 16/260,505, filed on Jan. 29, 2019, now Pat. No. 10,886,618.

(30) Foreign Application Priority Data

Mar. 30, 2018 (KR) ..... 10-2018-0037621
Jul. 9, 2018 (KR) ..... 10-2018-0079286

(51) Int. Cl.
*H01Q 9/04* (2006.01)
*H01Q 1/38* (2006.01)
(Continued)

(52) U.S. Cl.
CPC ..... *H01Q 9/0457* (2013.01); *H01Q 1/38* (2013.01); *H01Q 9/0464* (2013.01);
(Continued)

(58) Field of Classification Search
CPC ..... H01Q 9/0457; H01Q 1/38; H01Q 9/0464; H01Q 21/0025; H01Q 21/065; H01Q 1/243
See application file for complete search history.

(56) References Cited

U.S. PATENT DOCUMENTS 6,262,495 B1 7/2001 Yablonovitch et al.
2007/0052587 A1 3/2007 Cheng
(Continued)

FOREIGN PATENT DOCUMENTS

CN 1874066 A 12/2006
CN 101145638 A 3/2008
(Continued)

OTHER PUBLICATIONS

Korean Office Action dated Mar. 15, 2019 in counterpart Korean Patent Application No. 10-2018-0079286 (4 pages in English, 4 pages in Korean).
(Continued)

*Primary Examiner* — Wei (Victor) Y Chan
(74) *Attorney, Agent, or Firm* — NSIP Law

(57) ABSTRACT

An antenna apparatus includes a feed via, a patch antenna pattern which is electrically connected to a first end of the feed via, a plurality of first conductive array patterns, respectively disposed to be spaced apart from the patch antenna pattern and arranged to correspond to at least a portion of a side boundary of the patch antenna pattern, and a first conductive ring pattern spaced apart from the patch antenna pattern and the plurality of conductive array patterns
(Continued)

and configured to surround the patch antenna pattern and the plurality of conductive array patterns.

13 Claims, 16 Drawing Sheets

(51) Int. Cl.
*H01Q 21/06* (2006.01)
*H01Q 21/00* (2006.01)
*H01Q 1/24* (2006.01)

(52) U.S. Cl.
CPC ..... *H01Q 21/0025* (2013.01); *H01Q 21/065* (2013.01); *H01Q 1/243* (2013.01)

(56) References Cited

U.S. PATENT DOCUMENTS

| | | | | |
|---|---|---|---|---|
| 2007/0117514 | A1 | 5/2007 | Gainey et al. | |
| 2008/0068269 | A1 | 3/2008 | Yamada | |
| 2009/0079637 | A1* | 3/2009 | Fukui | H01Q 15/008 343/700 MS |
| 2009/0096707 | A1 | 4/2009 | Hur et al. | |
| 2010/0085128 | A1 | 4/2010 | Cho et al. | |
| 2012/0162015 | A1 | 6/2012 | Chen et al. | |
| 2014/0361952 | A1 | 12/2014 | Dobric et al. | |
| 2015/0070228 | A1 | 3/2015 | Gu et al. | |
| 2015/0123869 | A1 | 5/2015 | Bit-Babik et al. | |
| 2016/0056544 | A1 | 2/2016 | Garcia et al. | |
| 2017/0352960 | A1* | 12/2017 | Zhang | H05K 1/0221 |
| 2018/0205151 | A1* | 7/2018 | Celik | H01Q 15/006 |

FOREIGN PATENT DOCUMENTS

| | | | |
|---|---|---|---|
| CN | 101183744 | A | 5/2008 |
| CN | 101471492 | A | 7/2009 |
| CN | 101540435 | A | 9/2009 |
| CN | 1941504 | B | 5/2011 |
| CN | 102570013 | A | 7/2012 |
| CN | 204577606 | U | 8/2015 |
| CN | 106910999 | A | 6/2017 |
| JP | 2008-283381 | A | 11/2008 |
| KR | 10-2009-0038128 | A | 4/2009 |
| KR | 10-2010-0039589 | A | 4/2010 |
| KR | 10-2011-0127394 | A | 11/2011 |
| KR | 10-2014-0123504 | A | 10/2014 |

OTHER PUBLICATIONS

Chinese Office Action dated Apr. 3, 2020 issued in counterpart Chinese Patent Application No. 201910249186.7 (18 pages in English and 13 pages in Chinese).

Chinese Office Action dated Nov. 13, 2020 in counterpart Chinese Patent Application No. 201910249186.7 (16 pages English, 9 pages in Chinese).

Korean Notice of Allowance dated Jul. 31, 2021, issued in counterpart Korean Patent Application No. 10-2019-0128177 (2 pages in English and 2 pages in Korean).

Silva et al. "Performance of microstrip antennas in the presence of EBG in an indoor localization system." 2011 *IEEE International Symposium on Antennas and Propagation* (*APSURSI*). IEEE, 2011. (4 pages in English).

Hadarig et al. "Bandwidth enhancement through coupling microstrip patch antenna and electromagnetic band-gap resonances." 2012 *6th European Conference on Antennas and Propagation* (*EUCAP*). IEEE, 2012. (4 pages in English).

Patil, et al. "Performance Improvement of Microstrip Antenna Using EBG Structure." *International Journal of Emerging Technology and Advanced Engineering* 5.07 (2015): 74-78. (4 pages in English).

Zheng Song et al "Antenna and Electromagnetic Wave Propagation", Xidian University Press, pp. 218-220, Apr. 2016 (English translation included) (6 pages in English, 3 pages in Chinese).

Chinese Office Action dated Apr. 19, 2021 in counterpart Chinese Patent Application No. 201910249186.7 (10 pages in English, 5 pages in Chinese).

* cited by examiner

ANTENNA APPARATUS AND ANTENNA MODULE

CROSS-REFERENCE TO RELATED APPLICATIONS

This application is a Continuation of U.S. patent application Ser. No. 16/260,505, filed on Jan. 29, 2019, now U.S. Pat. No. 10,866,618 issued on Jan. 5, 2021, which claims the benefit under 35 USC 119(a) of Korean Patent Application Nos. 10-2018-0037621 filed on Mar. 30, 2018, and 10-2018-0079286 filed on Jul. 9, 2018 in the Korean Intellectual Property Office, the entire disclosures of which are incorporated herein by reference for all purposes.

BACKGROUND

1. Field

This application relates to an antenna apparatus and an antenna module.

2. Description of Related Art

Mobile communications data traffic increases rapidly every year. Technological developments to support the rapid increase in data traffic in wireless networks in real time are being implemented. For example, data generated by applications such as Internet of Things (IoT), augmented reality (AR), virtual reality (VR), live VR/AR combined with social network services (SNS), autonomous driving, sync view (real-time image transmission of user's view using a compact camera), and similar applications, require communications infrastructure (e.g., $5^{th}$-generation (5G) communications, millimeter wave (mmWave) communications, etc.) which support the exchange of mass amounts of data.

RF signals of high frequency bands (e.g., 24 GHz, 28 GHz, 36 GHz, 39 GHz, 60 GHz, etc.) are easily absorbed in the course of transmissions and lead to signal loss, so that the quality of communications may be drastically lowered. Therefore, antennas for communications in high-frequency bands require a technical approach different from that of typical antenna technology, and the development of special technologies such as a separate power amplifier for securing antenna gain, integrating an antenna and a radio frequency integrated circuit (RFIC), securing effective isotropic radiated power, and the like, may be required.

The above information is presented as background information only to assist with an understanding of the present disclosure. No determination has been made, and no assertion is made, as to whether any of the above might be applicable as prior art with regard to the disclosure.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes a feed via, a patch antenna pattern capable of being electrically connected to a first end of the feed via, a plurality of first conductive array patterns, respectively spaced apart from the patch antenna pattern and arranged to correspond to at least a portion of a side boundary of the patch antenna pattern, and a first conductive ring pattern spaced apart from the patch antenna pattern and the plurality of conductive array patterns, and surrounding the patch antenna pattern and the plurality of conductive array patterns.

The antenna apparatus may include a ground layer including a through-hole configured to allow the feed via to pass therethrough; and one or more grounding vias disposed to electrically connect the conductive ring pattern and the ground layer.

The plurality of conductive array patterns may be electrically separated from the ground layer.

The at least one grounding via includes a plurality of vias, and are arranged to surround the feed via.

The antenna apparatus may further include a feed line, and an end-fire antenna pattern electrically connected to one end of the feed line, wherein the at least one grounding via is disposed between the patch antenna pattern and the end-fire antenna pattern.

The antenna apparatus may further include a plurality of second conductive array patterns disposed above or below the plurality of first conductive array patterns, and arranged to correspond to at least the portion of the side boundary of the patch antenna pattern, and a second conductive ring pattern disposed above or below the first conductive ring pattern and surrounding the plurality of second conductive array patterns.

The antenna apparatus may further include a plurality of array vias disposed to electrically connect the plurality of first conductive array patterns and the plurality of second conductive array patterns, respectively, and at least one connection via disposed to electrically connect the first conductive ring pattern and the second conductive ring pattern.

The antenna apparatus may further include a coupling patch pattern disposed above the patch antenna pattern, wherein at least a portion of the coupling patch pattern is surrounded by the plurality of second conductive array patterns.

The first conductive ring pattern, the plurality of first conductive array patterns, and the patch antenna pattern may be disposed on a same first level, and the second conductive ring pattern, the plurality of second conductive array patterns, and the coupling patch pattern may be disposed on a same second level.

A plurality of third conductive array patterns may be disposed between the plurality of first conductive array patterns and the plurality of second conductive array patterns and may be arranged to correspond to at least the portion of the side boundary of the patch antenna pattern, and a third conductive ring pattern may be disposed between the first conductive ring pattern and the second conductive ring pattern and may be configured to surround the plurality of third conductive array patterns.

The plurality of first conductive array patterns may have a same shape, and may be spaced apart from each other, and an interval between each of the plurality of first conductive array patterns may be shorter than an interval between the plurality of first conductive array patterns and the first conductive ring pattern.

In another general aspect, an antenna module includes a plurality of patch antennas, and a first conductive perforated plate pattern comprising a plurality of arrangement spaces in which the respective ones of the plurality of patch antennas are disposed, wherein at least one of the plurality of patch antennas includes a feed via, a patch antenna pattern configured to be electrically connected to a first end of the feed via, and a plurality of conductive array patterns, respectively disposed to be spaced apart from the patch antenna pattern and arranged to correspond to at least a portion of a side boundary of the patch antenna pattern.

A second conductive perforated plate pattern may be disposed above or below the conductive perforated plate pattern and including a same shape as a shape of the conductive perforated plate pattern, and at least one connection via may be disposed to electrically connect the conductive perforated plate pattern and the second conductive perforated plate pattern.

A ground layer may be disposed below the plurality of patch antennas and may include a through-hole which allows the feed via to pass therethrough, and at least one grounding via electrically connected to the conductive perforated plate pattern and the ground layer.

The antenna module may further include a plurality of end-fire antennas, wherein the at least one grounding via may be provided in plural numbers and may be respectively disposed between the plurality of patch antennas and the plurality of end-fire antennas.

An integrated circuit (IC) may be disposed below the ground layer, and may be electrically connected to each of the plurality of patch antennas and the plurality of end-fire antennas.

In another general aspect, an electronic device includes a circuit board comprising a first antenna module including an end-fire antenna pattern, a patch antenna pattern, an insulating layer capable of being mounted adjacent to a first side boundary of the electronic device, a communications module capable of being electrically coupled to the antenna module by a coaxial cable, and a baseband circuit, configured to generate a base signal, and transmit the generated base signal to the antenna module through the coaxial cable.

A second antenna module may be mounted adjacent to a second side boundary of the electronic device, wherein the first antenna module and the second antenna module may be electrically connected to the communications module and the baseband circuit by one or more coaxial cables.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
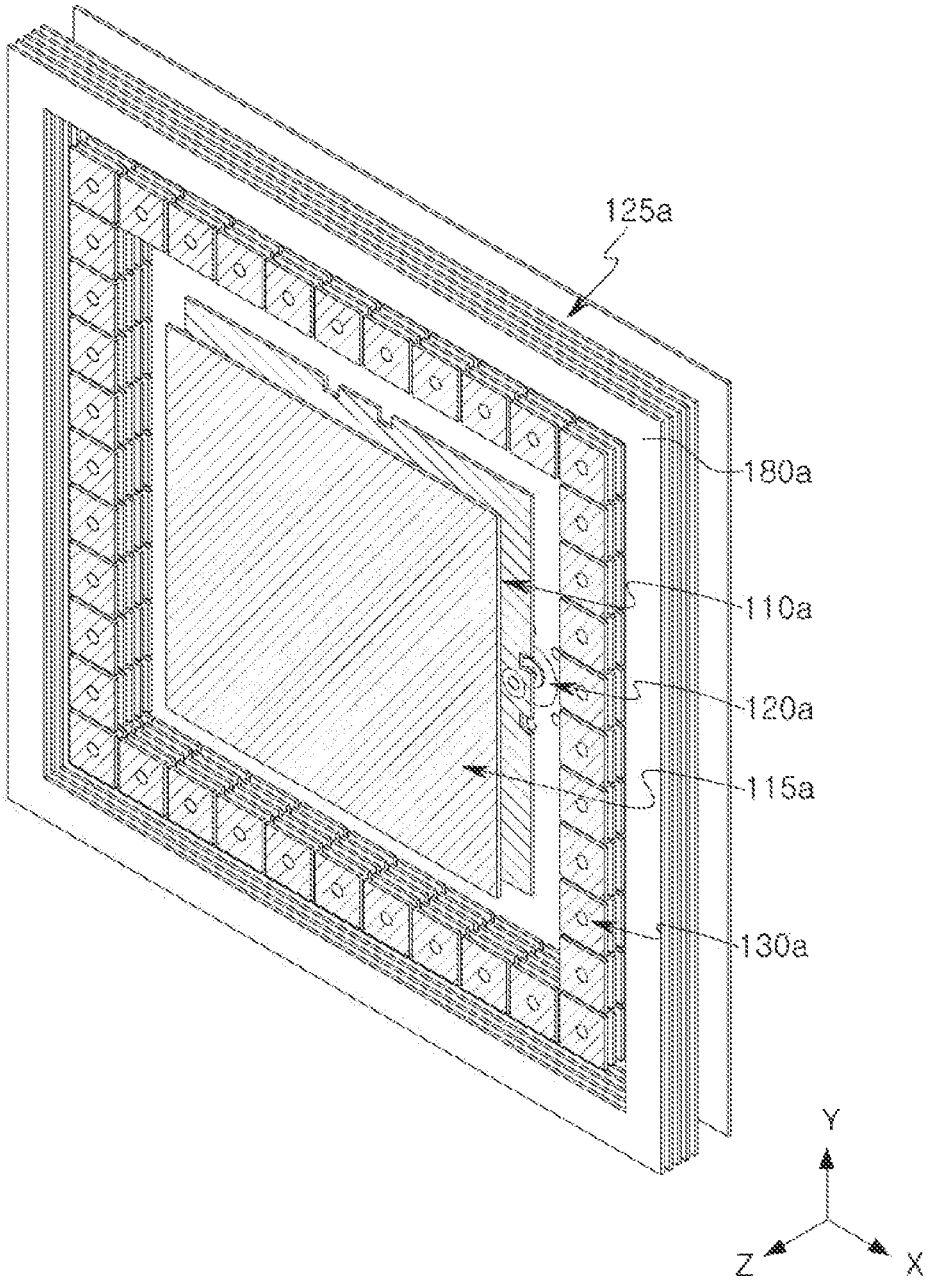
FIG. 1 illustrates a perspective view of an example of an antenna apparatus.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure.

The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

FIG. 1 is a perspective view illustrating an example of an antenna apparatus.

Referring to FIG. 1, the antenna apparatus according to an example may include a patch antenna pattern 110*a*, a feed via 120*a*, a conductive array pattern 130*a*, and a conductive ring pattern 180*a*.

The feed via 120*a* may be configured to allow a radio frequency (RF) signal to pass therethrough. For example, the feed via 120*a* may electrically connect an integrated chip (IC) and the patch antenna pattern 110*a*, and may extend in the Z direction.

The patch antenna pattern 110*a* may be electrically connected to one end of the feed via 120*a*. The patch antenna pattern 110*a* may receive the RF signal from the feed via 120*a* and transmit the received RF signal in the Z direction and may deliver the RF signal received in the Z direction to the feed via 120*a*.

Some of the RF signals transmitted through the patch antenna pattern 110*a* may be oriented toward a ground layer 125*a* disposed on a lower side of the antenna apparatus. The RF signal oriented toward the ground layer 125*a* may be reflected from the ground layer 125*a* and may orient in the Z direction. Accordingly, the RF signal transmitted through the patch antenna pattern 110*a* may be further concentrated in the Z direction.

For example, the patch antenna pattern 110*a* may have a structure of a patch antenna which has both sides formed in a circular or polygonal shape (not shown). Both sides of the patch antenna pattern 110*a* may act as a boundary through which the RF signal passes between a conductor and a non-conductor. The patch antenna pattern 110*a* may have an inherent frequency band (e.g., 28 GHz) in accordance with intrinsic factors (e.g., shape, size, height, dielectric constant of an insulating layer, etc.).

A plurality of conductive array patterns 130*a* may be disposed to be spaced apart from the patch antenna pattern 110*a* and arranged to correspond to at least a portion of a side boundary of the patch antenna pattern 110*a*. The plurality of conductive array patterns 130*a* may be electromagnetically coupled to the patch antenna pattern 110*a* and guide a path of the RF signal of the patch antenna pattern 110*a* in the Z direction.

For example, the plurality of conductive array patterns 130*a* may have the same shape and may be repeatedly arranged. That is, the plurality of conductive array patterns 130*a* may have electro-magnetic bandgap characteristics and may have a negative refractive index with respect to an RF signal. Accordingly, the path of the RF signal of the patch antenna pattern 110*a* may be further guided in the Z direction.

The plurality of conductive array patterns 130*a* may be electromagnetically coupled to the patch antenna patterns 110*a*, and thus, the factors (e.g., height, shape, size, number, spacing, distance to the patch antenna pattern, etc.) of the plurality of conductive array patterns 130*a* may affect frequency characteristics of the patch antenna pattern 110*a*.

Most of the RF signals transmitted through the plurality of conductive array patterns 130*a* may be guided to transmit in a direction that is close to the Z direction, but some of the RF signals may transmit in a direction that is different from the Z direction. Thus, some of the RF signals transmitted through the plurality of conductive array patterns 130*a* may leak in the X direction and/or the Y direction in the plurality of conductive array patterns 130*a*.

In an example, the conductive ring pattern 180*a* is configured to be spaced apart from the patch antenna pattern 110*a* and the plurality of conductive array patterns 130*a*, and may surround the patch antenna pattern 110*a* and the plurality of conductive array patterns 130*a*.

Thus, the conductive ring pattern 180*a* may reflect an RF signal leaking in the X direction and/or the Y direction among the RF signals transmitted through the plurality of conductive array patterns 130*a*. The RF signal reflected from the conductive ring pattern 180*a* may thus be guided in the Z direction in the plurality of conductive array patterns 130*a*.

Therefore, the antenna apparatus according to the example may allow the RF signal to be further concentrated in the Z direction, thus obtaining a further improved gain, and since the phenomenon that the RF signal leaks to an adjacent antenna apparatus is reduced, electromagnetic isolation for the adjacent antenna apparatus may be enhanced, and thus, the antenna apparatus may be disposed to be closer to the adjacent antenna apparatus. Therefore, an antenna module including a plurality of antenna apparatuses, according to an example, may be further reduced in size.

In an example, the antenna apparatus may further include a coupling patch pattern 115*a* disposed above the patch antenna pattern 110*a* and disposed to be surrounded in at least a portion thereof by the plurality of conductive array patterns 130*a* when viewed in the up-down direction (that is, the Z direction). Accordingly, the antenna apparatus according to an example may have a larger bandwidth.

Because of the arrangement of the coupling patch pattern 115*a*, an optimal position for connection of the feed via 120*a* in the patch antenna pattern 110*a* may be close to the boundary of the patch antenna pattern 110*a*. A surface current flowing through the patch antenna pattern 110*a* in accordance with RF signal transmission and reception of the patch antenna pattern 110*a* may flow toward a third direction (e.g., 180° direction) of the patch antenna pattern 110*a*. Here, the surface current may be dispersed in a second direction (e.g., 90° direction) and a fourth direction (e.g., 270° direction), and thus, the plurality of conductive array patterns 130*a* and/or the conductive ring pattern 180*a* may guide an RF signal, which leaks to the side as the surface current is dispersed in the second and fourth directions, toward an upper surface of the patch antenna pattern 110*a*. Accordingly, a radiation pattern of the patch antenna pattern 110*a* may be further concentrated in the direction of the upper surface of the patch antenna pattern 110*a*, and thus, antenna performance of the patch antenna pattern 110*a* may be enhanced. The coupling patch pattern 115*a* may be omitted according to a configuration.

Figure 2A:
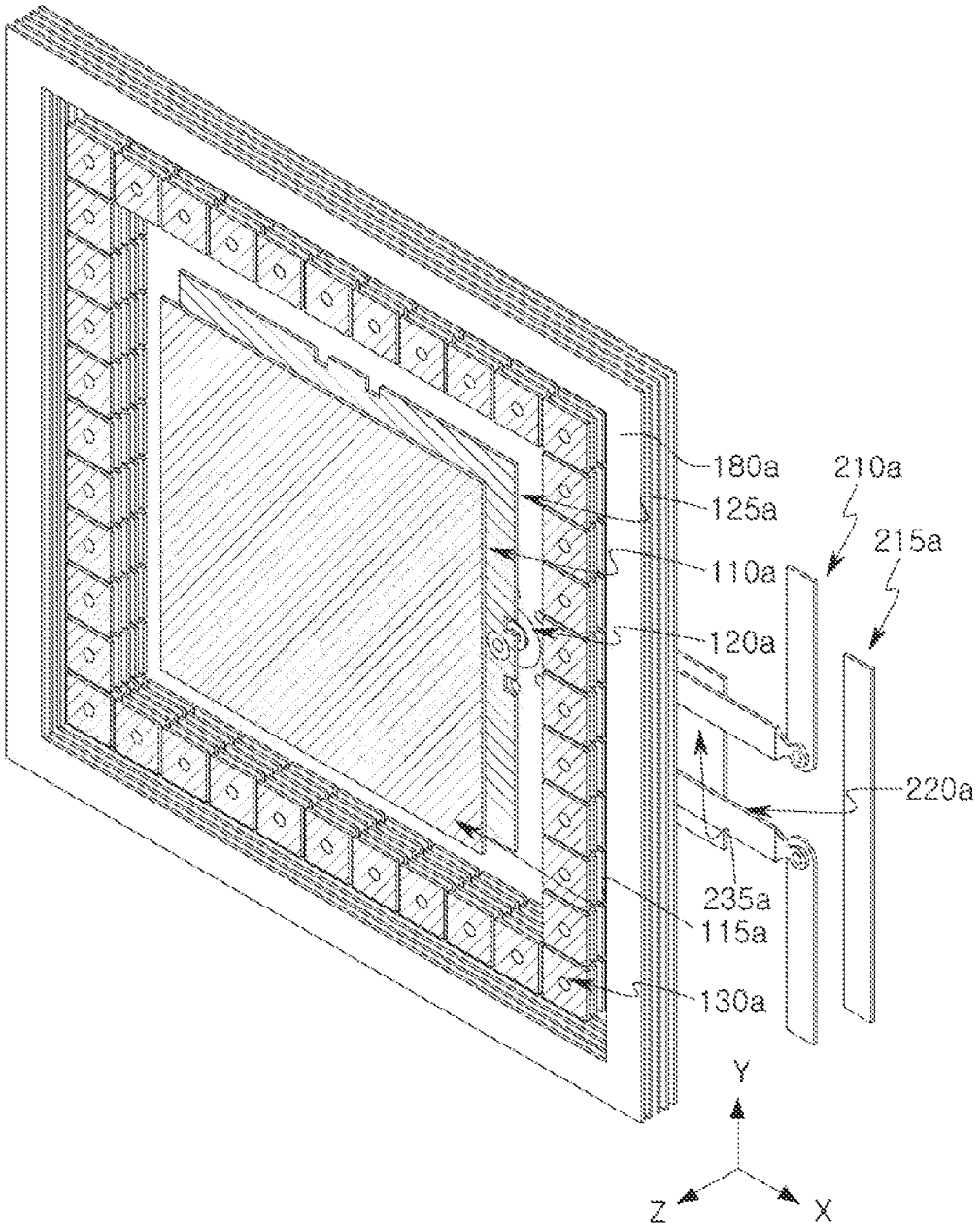
FIGS. 2A through 2C are views illustrating examples of a structure in which an end-fire antenna is additionally disposed in the antenna apparatus of FIG. 1.

FIG. 2A is a perspective view illustrating an example of a structure in which an end-fire antenna is additionally disposed in the antenna apparatus illustrated in FIG. 1.

Referring to FIG. 2A, an antenna apparatus according to an example may further include an end-fire antenna pattern 210*a*, a director pattern 215*a*, a feed line 220*a*, and a coupling ground pattern 235*a*.

The end-fire antenna pattern 210*a* may form a radiation pattern in a second direction (e.g., X direction) to transmit or receive an RF signal in the second direction (e.g., X direction). Accordingly, the antenna apparatus according to the example may expand an RF signal transmission/reception direction to all directions.

For example, the end-fire antenna pattern 210*a* may have the form of a dipole or a folded dipole, but is not limited thereto. Here, one end of each pole of the end-fire antenna pattern 210*a* may be electrically connected to the feed line 220*a*. A frequency band of the end-fire antenna pattern 210*a* may be configured to be substantially equal to a frequency band of the patch antenna pattern 110*a* but is not limited thereto.

The director pattern 215*a* may be electromagnetically coupled to the end-fire antenna pattern 210*a* to improve a gain or bandwidth of the end-fire antenna pattern 210*a*.

The feed line 220*a* may transmit an RF signal received from the end-fire antenna pattern 210*a* to the IC and may transmit an RF signal received from the IC to the end-fire antenna pattern 210*a*.

The conductive ring pattern 180*a* may improve electromagnetic isolation between the patch antenna pattern 110*a* and the end-fire antenna pattern 210*a*. Therefore, the antenna apparatus according to the example may be further miniaturized, while ensuring antenna performance.

The coupling ground pattern 235*a* may be disposed on an upper side or a lower side of the feed line 220*a*. The coupling ground pattern 235*a* may be electromagnetically coupled to the end-fire antenna pattern 210*a*. Thus, the end-fire antenna pattern 210*a* may have a larger bandwidth.

Figure 2B:
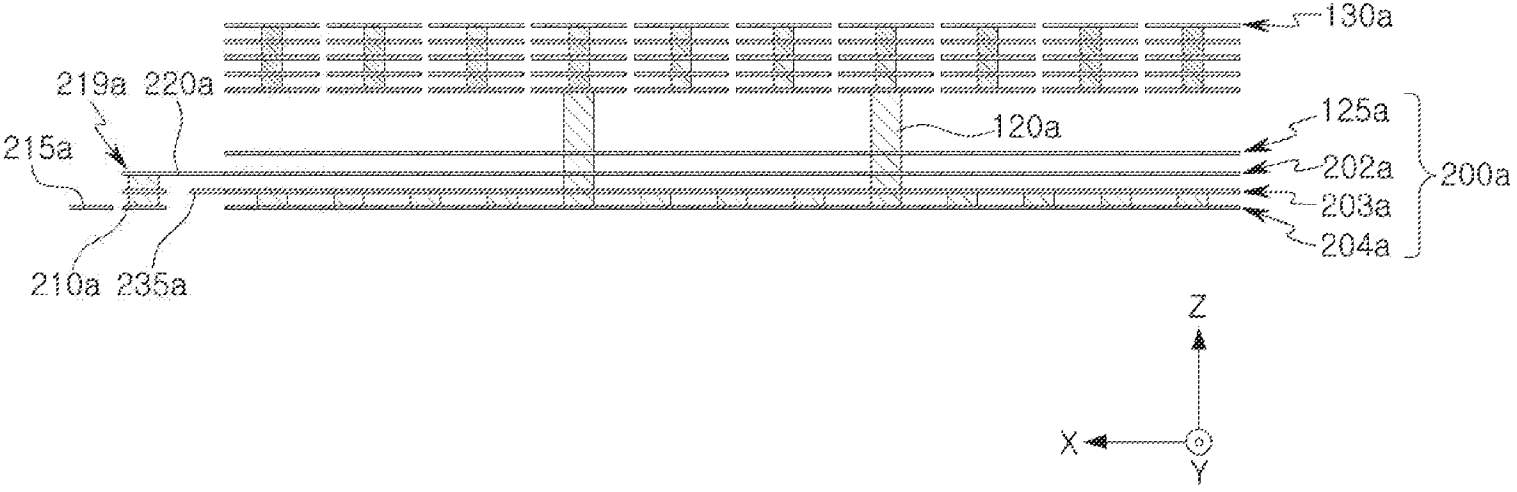

FIG. 2B is a side view of the antenna apparatus illustrated in FIG. 2A.

Referring to FIG. 2B, the patch antenna pattern and the coupling patch pattern may be disposed on layers in which the plurality of conductive array patterns 130*a* and the conductive ring pattern 180*a* are respectively disposed. Accordingly, the plurality of conductive array patterns 130*a* and the conductive ring pattern 180*a* may efficiently guide an RF signal leaking from the patch antenna pattern to the direction of the upper surface of the patch antenna pattern 110*a*.

The conductive array pattern 130*a* and the conductive ring pattern 180*a* may each have a plurality of (e.g., five) layers. RF signal guiding performance of the conductive array pattern 130*a* and RF signal reflection performance of the conductive ring pattern 180*a* may be improved as the number of layers of the conductive array pattern 130*a* and the conductive ring pattern 180*a* increases.

A connection member 200*a* may include the ground layer 125*a* described above and may further include a wiring ground layer 202*a*, a second ground layer 203*a*, and an IC ground layer 204*a*. The feed line 220*a* may be disposed on the same level with respect to the wiring ground layer 202*a*.

Figure 2C:
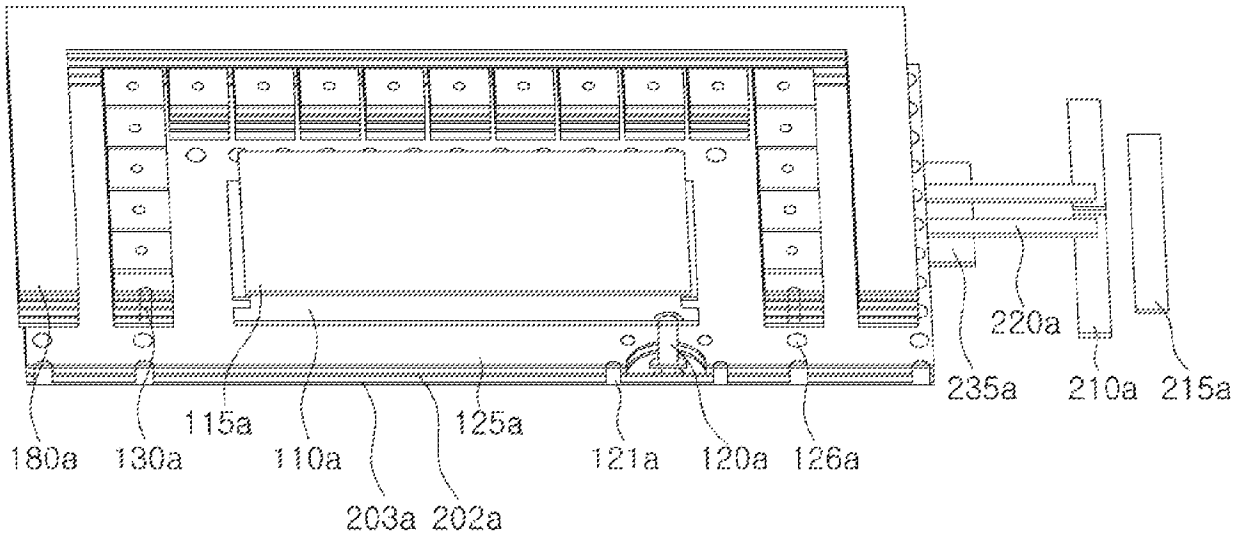

FIG. 2C is a cross-sectional view of an example of the antenna apparatus illustrated in FIG. 2A.

Referring to FIG. 2C, the plurality of conductive array patterns 130*a* may be arranged in a row. An interval between the plurality of conductive array patterns 130*a* may be shorter than an interval between the plurality of conductive array patterns 130*a* and the conductive ring pattern 180*a*. As a result, the plurality of conductive array patterns 130*a* may guide the RF signal in the Z direction more efficiently.

Referring to FIG. 2C, a plurality of first shielding vias 126*a* may be arranged below the plurality of conductive array patterns 130*a*, and a plurality of second shielding vias 121*a* may be arranged to surround the feed via 120*a*. Accordingly, electromagnetic noise affecting the feed via 120*a* may be reduced, and transmission loss of the RF signal may be reduced.

Figure 3A:
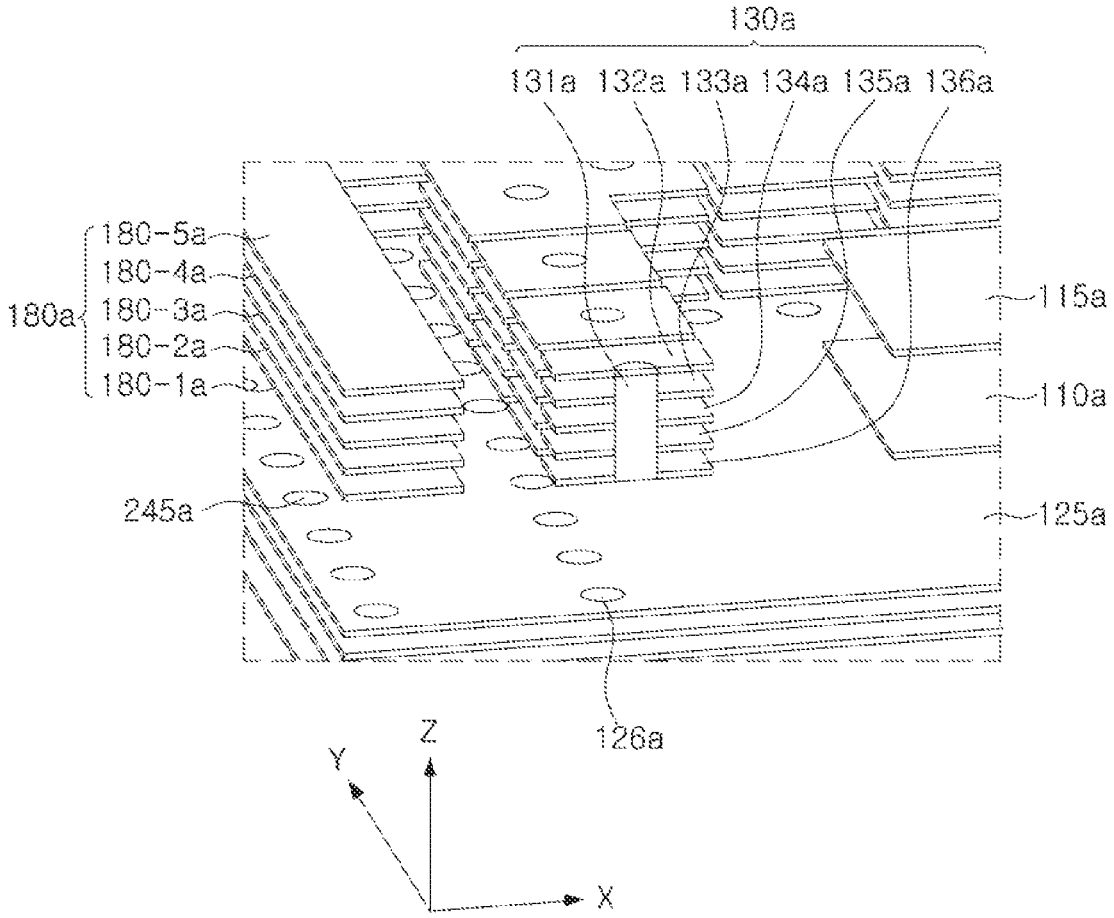
FIGS. 3A and 3B illustrate perspective views of examples of a conductive array pattern and a conductive ring pattern of an antenna apparatus.
Figure 3B:
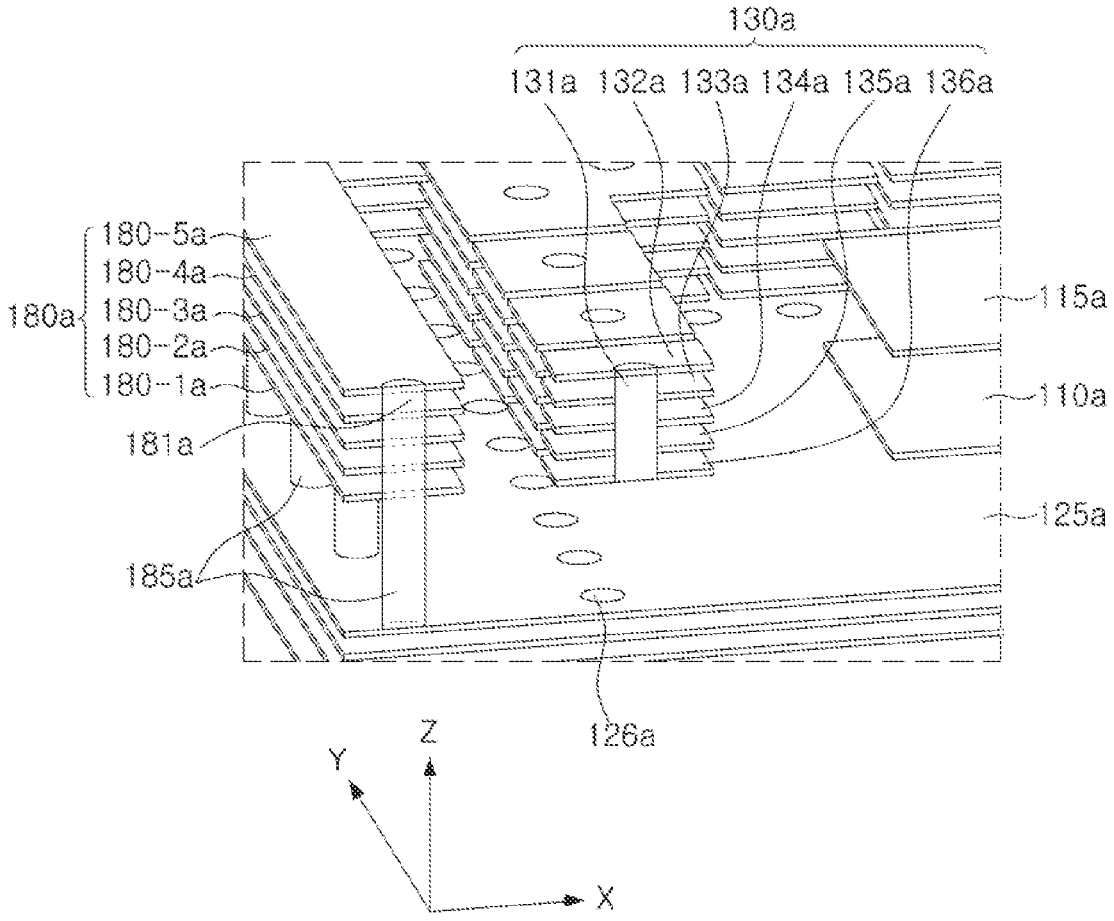

FIGS. 3A and 3B are perspective views specifically illustrating an example of a conductive array pattern and a conductive ring pattern of an antenna apparatus.

Referring to FIGS. 3A and 3B, the plurality of conductive array patterns 130*a* may include a plurality of first conductive array patterns 136*a*, a plurality of second conductive array patterns 132*a*, a plurality of third conductive array patterns 133*a*, a plurality of fourth conductive array patterns 134*a*, and a plurality of fifth conductive array patterns 135*a*. The plurality of first, second, third, fourth and fifth conductive array patterns 136*a*, 132*a*, 133*a*, 134*a*, and 135*a* may be electrically connected by a plurality of array vias 131*a*. Accordingly, the plurality of conductive array patterns 130*a* may have characteristics closer to electromagnetic bandgap characteristics.

The conductive ring pattern 180*a* may include a first conductive ring pattern 180-1*a*, a second conductive ring pattern 180-5*a*, a third conductive ring pattern 180-2*a*, a fourth conductive ring pattern 180-3*a* and a fifth conductive ring pattern 180-4*a* which are arranged in a parallel manner.

For example, the plurality of first conductive array patterns 136*a* may be disposed on the same level with respect to the patch antenna pattern 110*a* and the first conductive ring pattern 180-1*a* of the conductive ring pattern 180*a*, and the plurality of second conductive array patterns 132*a* may be disposed on the same level with respect to the coupling patch pattern 115*a* and the second conductive ring pattern 180-5*a* of the conductive ring pattern 180*a*. Accordingly, the plurality of conductive array patterns 130*a* and the conductive ring pattern 180*a* may more efficiently guide the RF signal transmitted through the patch antenna pattern 110*a* to the Z direction.

Referring to FIG. 3B, the antenna apparatus according to an example may further include a connection via 181*a* electrically connecting the first and second conductive ring patterns 180-1*a* and 180-5*a* of the conductive ring pattern 180*a*. The connection via 181*a* may also electrically connect the third conductive ring pattern 180-2*a*, the fourth conductive ring pattern 180-3*a* and the fifth conductive ring pattern 180-4*a*. Accordingly, leakage of the RF signal transmitted through the patch antenna pattern 110*a* in the X direction and/or the Y direction may be further reduced.

Referring to FIG. 3B, the antenna apparatus according to an example may further include at least one grounding via 185*a* arranged to electrically connect the conductive ring pattern 180*a* and the ground layer 125*a*. For example, the at least one grounding via 185*a* may be provided in plural numbers, and may be arranged to surround the feed via 120*a*. Accordingly, leakage of the RF signal transmitted through the patch antenna pattern 110*a* in the X direction and/or the Y direction may be further reduced.

Additionally, since at least one grounding via 185*a* may be disposed between the patch antenna pattern 110*a* and the end-fire antenna pattern, electromagnetic isolation between the patch antenna pattern 110*a* and the end-fire antenna pattern may be further improved.

In an example, the plurality of conductive array patterns 130*a* may be electrically separated from the ground layer 125*a*. Accordingly, the plurality of conductive array patterns 130*a* may have characteristics more adaptive to the RF signal which has a frequency adjacent to a frequency band of the patch antenna pattern 110*a*, and thus, a bandwidth may be further widened.

Figure 3C:
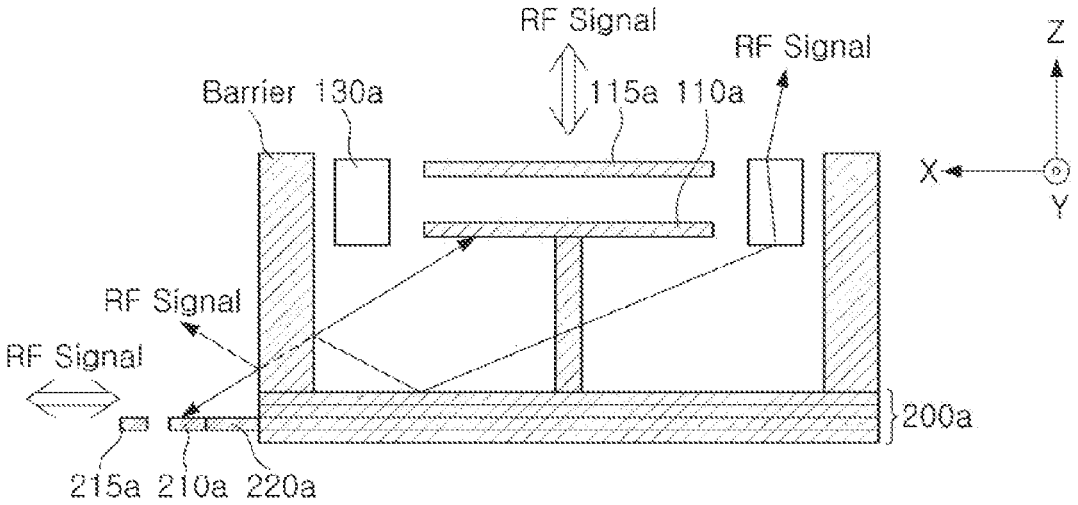
FIGS. 3C and 3D illustrate side views of examples of a barrier action of a conductive ring pattern of an antenna apparatus.
Figure 3D:
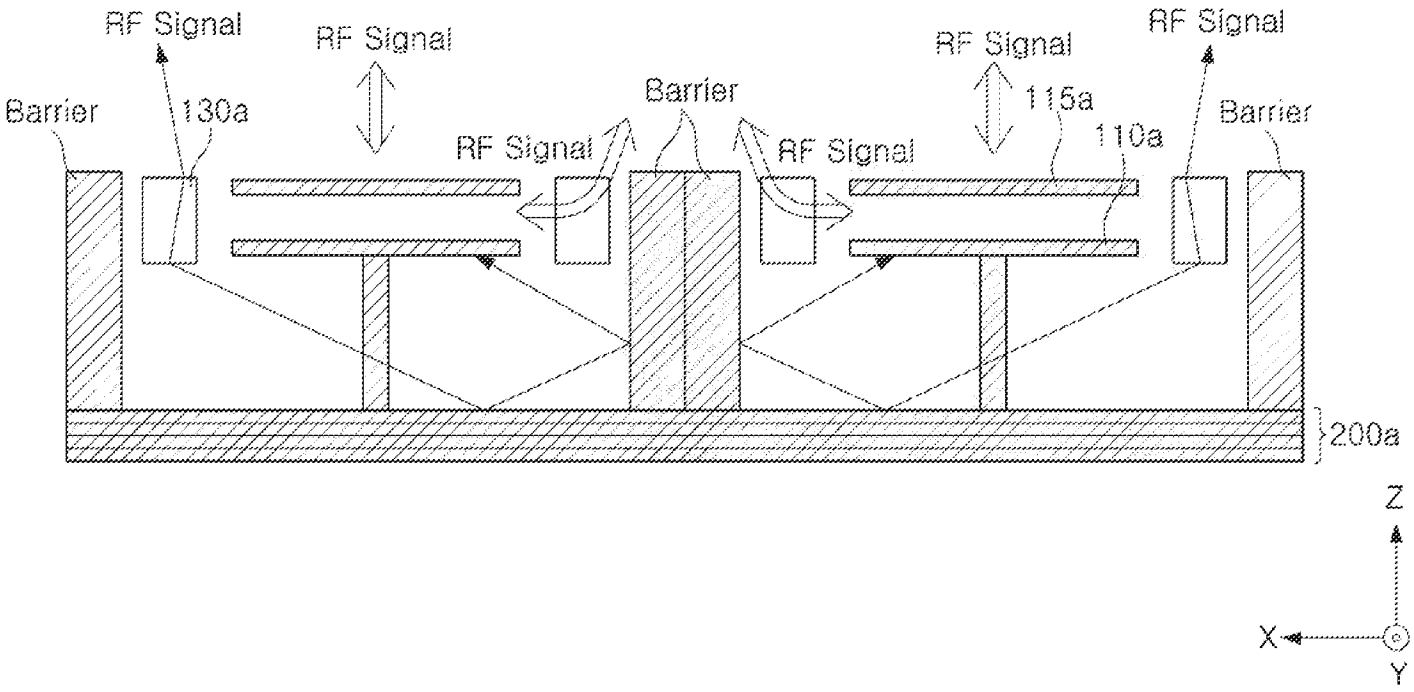

FIG. 3C and FIG. 3D are side views illustrating an example of a barrier action of the conductive ring pattern of the antenna apparatus.

Referring to FIG. 3C, an RF signal transmitted through the patch antenna pattern 110*a* may be reflected from a barrier, reflected from the ground layer of the connection member 200*a*, and refracted from the plurality of conductive array patterns 130*a*, so as to be transmitted in the Z direction.

Additionally, the RF signal transmitted through the end-fire antenna pattern 210*a* may be reflected from the barrier and transmitted in the X direction.

Since the barrier corresponds to the conductive ring pattern described above, the antenna apparatus according to the examples may improve electromagnetic isolation between the patch antenna pattern 110*a* and the end-fire antenna pattern 210*a*.

Referring to FIG. 3D, the RF signal transmitted through each of the plurality of patch antenna patterns 110*a* is reflected from the barrier, reflected from the ground layer of the connection member 200*a*, and refracted from the plurality of conductive array patterns 130*a* so as to be transmitted in the Z direction.

Therefore, the antenna apparatus according to the examples may improve electromagnetic isolation between the plurality of patch antenna patterns 110*a*.

Figure 3E:
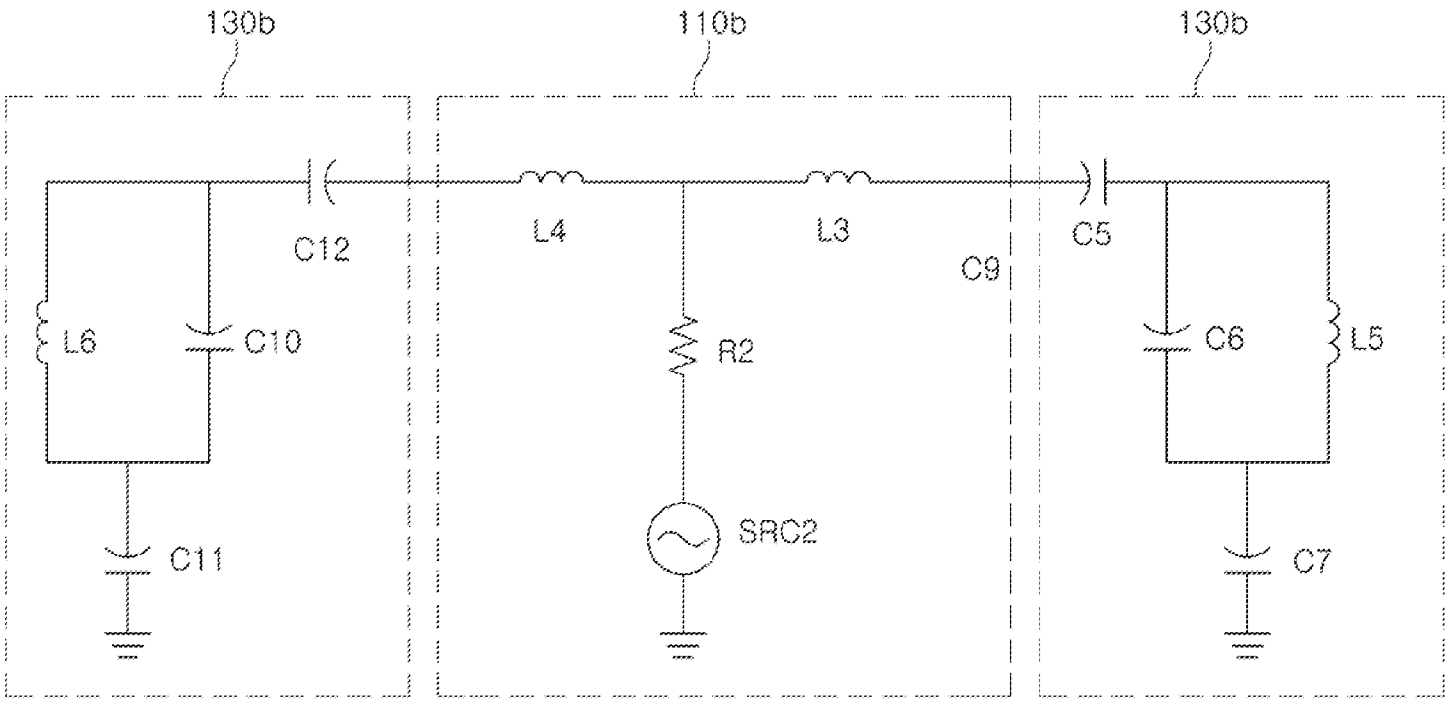
FIG. 3E illustrates an example of a circuit diagram of an equivalent circuit of an antenna apparatus.

FIG. 3E is a circuit diagram illustrating an example of an equivalent circuit of an antenna apparatus.

Referring to FIG. 3E, the patch antenna pattern 110*b* of the antenna apparatus according to an example may transmit or receive the RF signal to or from a source SRC2 such as an IC, and may have a resistance value R2 and inductances L3 and L4.

The plurality of conductive array patterns 130*b* may have capacitances C5 and C12 for the patch antenna pattern 110*b*, capacitances C6 and C10 between the plurality of conductive array patterns, inductances L5 and L6 of array vias, and capacitances C7 and C11 between the plurality of conductive array patterns and the ground layer.

A frequency band and a bandwidth of the antenna apparatus according to an example may be determined by the resistance value, the capacitances, and the inductances mentioned above.

FIGS. 4A to 4E are plan views illustrating examples of layers of an antenna apparatus.

Figure 4A:
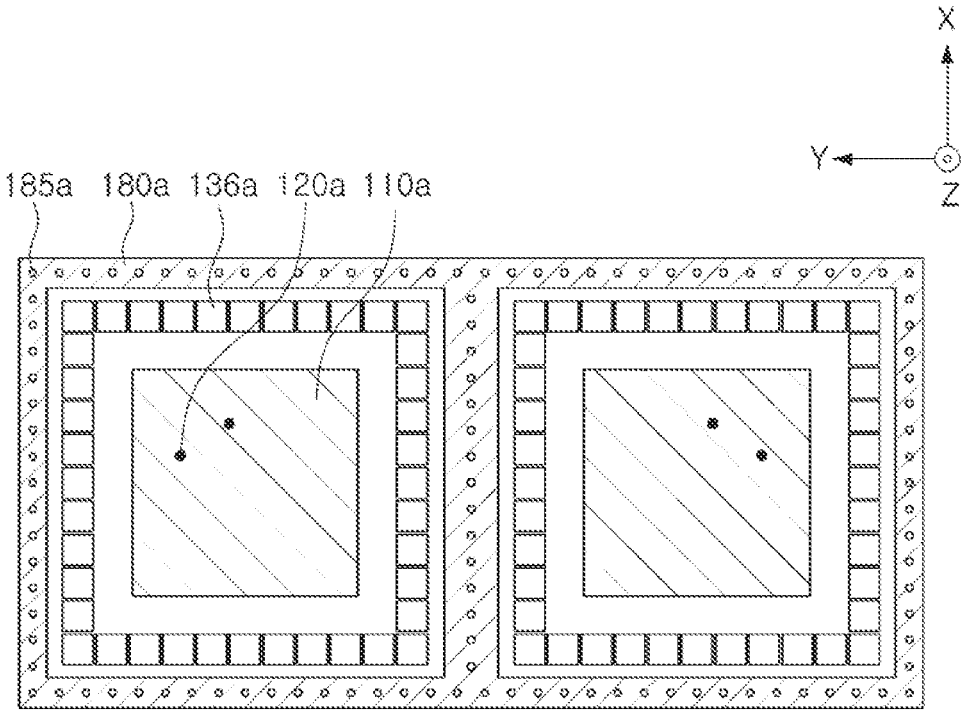
FIGS. 4A through 4E illustrate plan views of examples of each layer of an antenna apparatus.

Referring to FIG. 4A, one end of the feed via 120*a* may be connected to the patch antenna pattern 110*a*. The plurality of first conductive array patterns 136*a* may surround the patch antenna pattern 110*a*, and the conductive ring pattern 180*a* may surround the plurality of first conductive array patterns 136*a* and may be connected to one end of the grounding via 185*a*.

Figure 4B:
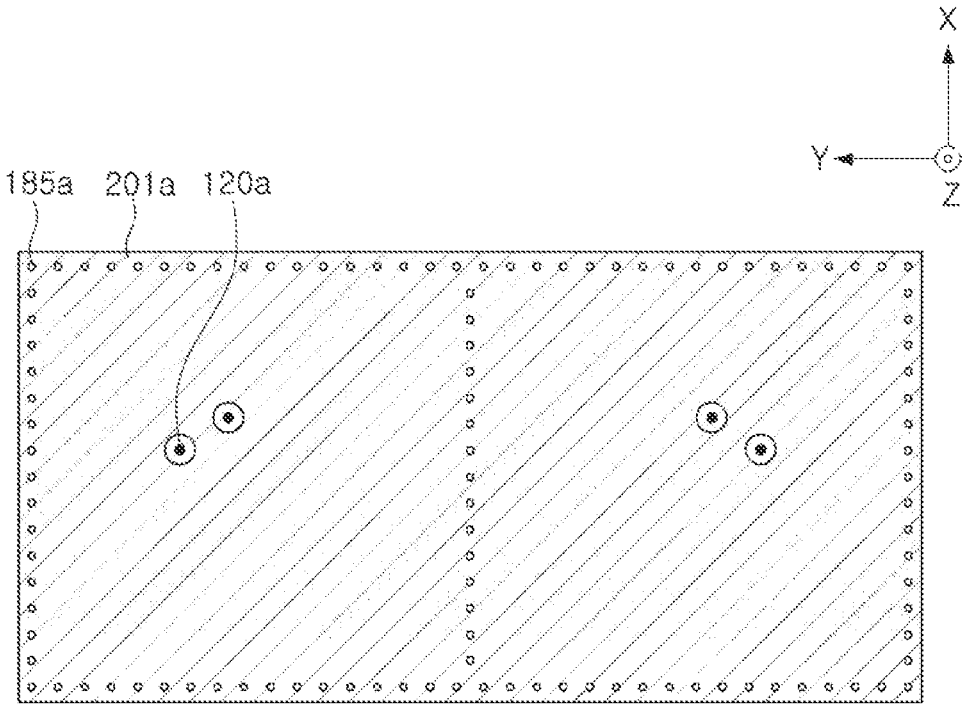

Referring to FIG. 4B, the ground layer 201*a* may have a through-hole through which the feed via 120*a* passes, and may be connected to the other end of the grounding via 185*a*. The ground layer 201*a* may electromagnetically shield the patch antenna pattern 110*a* and the feed line.

Figure 4C:
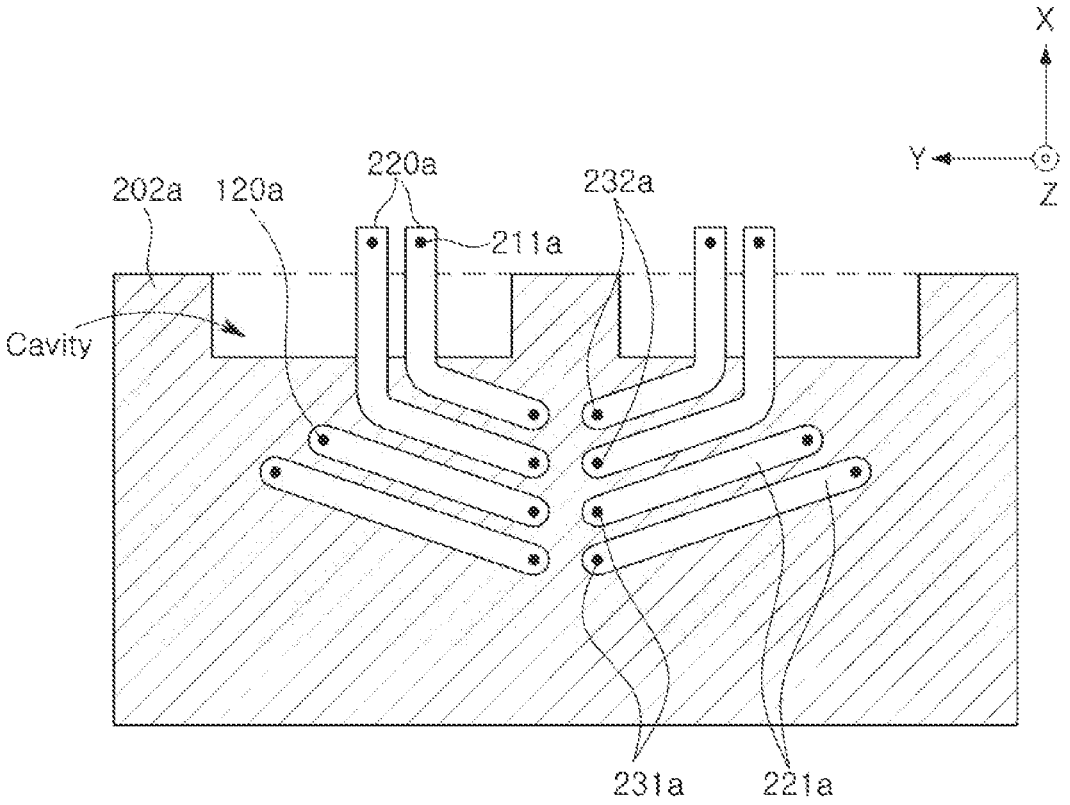

Referring to FIG. 4C, the wiring ground layer 202*a* may surround at least a portion of the feed line 220*a* and the patch antenna feed line 221*a*. The feed line 220*a* may be electrically connected to a second wiring via 232*a* and a patch antenna feed line 221*a* may be electrically connected to a first wiring via 231*a*. The wiring ground layer 202*a* may electromagnetically shield the feed line 220*a* and the patch antenna feed line 221*a*. One end of the feed line 220*a* may be connected to the second feed via 211*a*.

Figure 4D:
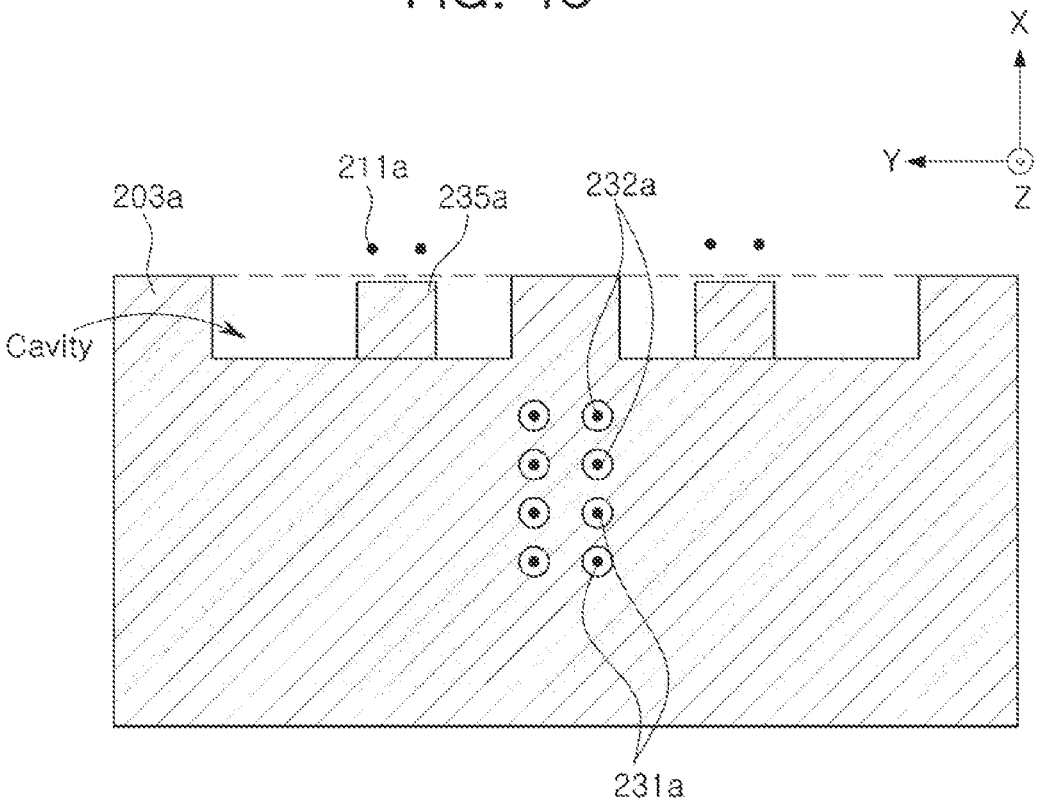

Referring to FIG. 4D, the second ground layer 203*a* may have a plurality of through-holes through which the respective first wiring vias 231*a* and the second wiring vias 232*a* pass, and a coupling ground pattern 235*a*. The second ground layer 203*a* may electromagnetically shield a feed line and an IC.

Figure 4E:
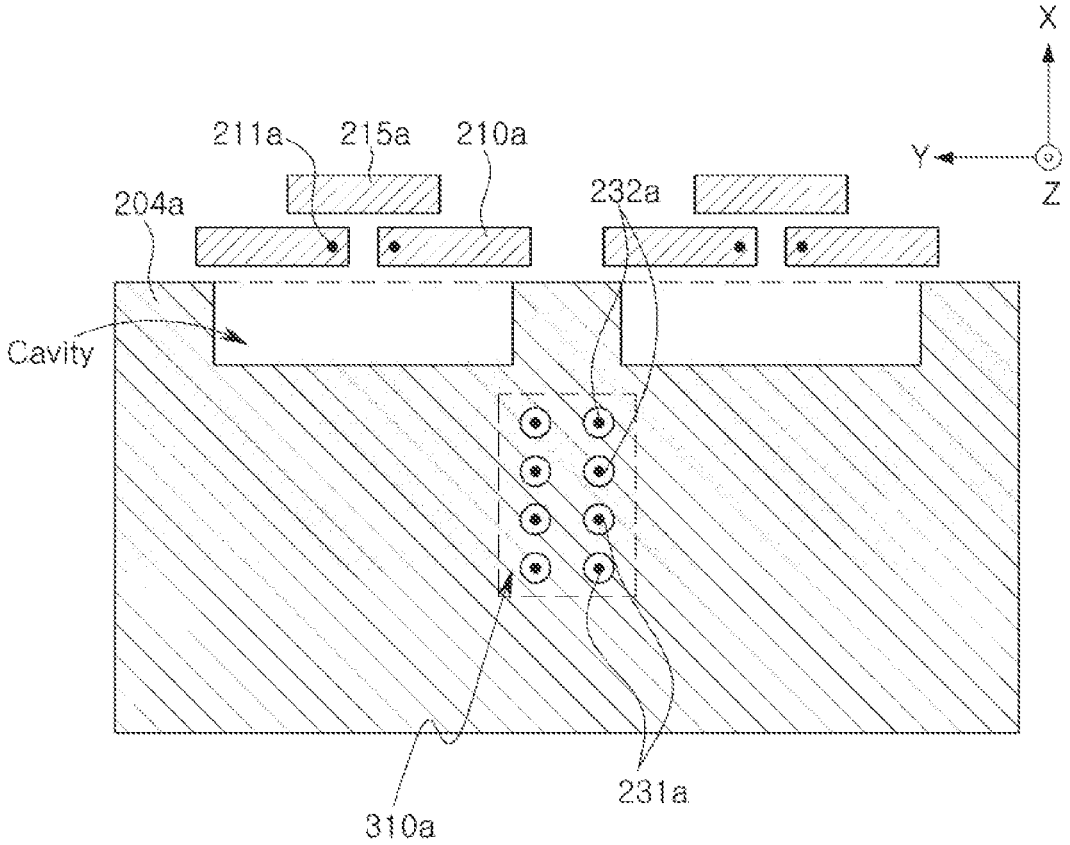

Referring to FIG. 4E, an IC ground layer 204*a* may have a plurality of through-holes through which the respective first wiring vias 231*a* and the second wiring vias 232*a* pass. An IC 310*a* may be disposed at a lower portion of the IC ground layer 204*a* and may be electrically connected to the first wiring via 231*a* and the second wiring via 232*a*. The end-fire antenna pattern 210*a* and the director pattern 215*a* may be disposed at substantially the same height as that of an IC ground layer 225.

The IC ground layer 204*a* may provide the IC 310*a* and/or passive components with the ground used in the circuitry and/or passive components of the IC 310*a*. Depending on the desired configuration, the IC ground layer 204*a* may provide a power and signal delivery path for use in the IC 310*a* and/or passive components. Thus, the IC ground layer 204*a* may be electrically connected to the IC and/or a passive component.

The wiring ground layer 202*a*, the second ground layer 203*a*, and the IC ground layer 204*a* may have a depressed shape to provide a cavity. Accordingly, the end-fire antenna pattern 210*a* may be disposed to be formed in a closer relation to the IC ground layer 204*a*.

In an example, an upper and lower relationship and shapes of the wiring ground layer 202*a*, the second ground layer 203*a*, and the IC ground layer 204*a* may vary based on a desired configuration.

Figure 5:
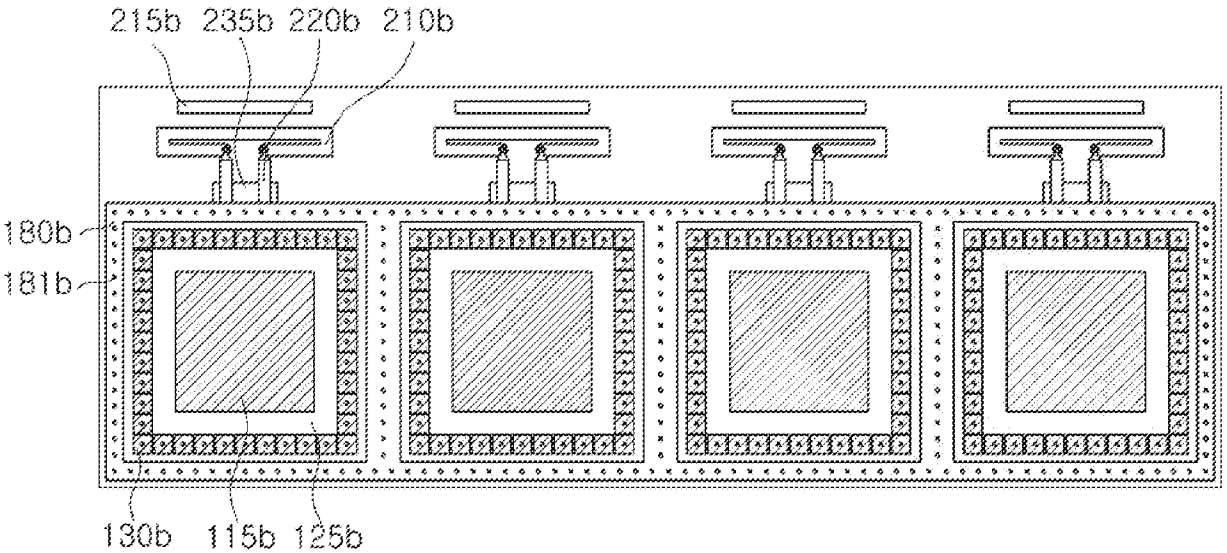
FIG. 5 illustrates a plan view of an example of an antenna module.

FIG. 5 is a plan view of an example of an antenna module.

Referring to FIG. 5, the antenna module according to an example may include at least some of a plurality of patch antenna patterns, a plurality of coupling patch patterns 115*b*, a ground layer 125*b*, a plurality of conductive array patterns 130*b*, a conductive perforated plate pattern 180*b*, a plurality of connection vias 181*b*, a plurality of end-fire antenna patterns 210*b*, a plurality of director patterns 215*b*, a plurality of feed lines 220*b*, and a plurality of coupling ground patterns 235*b*.

The conductive perforated plate pattern 180*b* may have a structure in which the aforementioned conductive ring pattern and the aforementioned conductive ring pattern are coupled to each other and may have a plurality of arrangement spaces in which the plurality of patch antennas (patch antenna pattern, feed via, and a set of a plurality of conductive array patterns) are respectively disposed.

Since the conductive perforated plate pattern 180*b* may have characteristics similar to the aforementioned conductive ring pattern, electromagnetic isolation of the plurality of patch antennas with respect to each other may be improved. For example, the conductive perforated plate pattern 180*b* may include first, second, third, fourth, and fifth conductive perforated plate patterns. The first, second, third, fourth, and fifth conductive perforated plate patterns may have the same shape and may be disposed at the same position when viewed in the up-down direction (e.g., the Z direction).

The plurality of connection vias 181*b* may electrically connect the first, second, third, fourth, and fifth conductive perforated plate patterns. Also, the conductive perforated plate pattern 180*b* may be electrically connected to the ground layer 125*b* through the grounding vias.

The antenna apparatus according to an example may be arranged in a 1×n structure. Here, n is a natural number. An antenna module in which antenna apparatuses are arranged in the 1×n structure may be efficiently disposed at a corner of an electronic device.

Figure 6A:
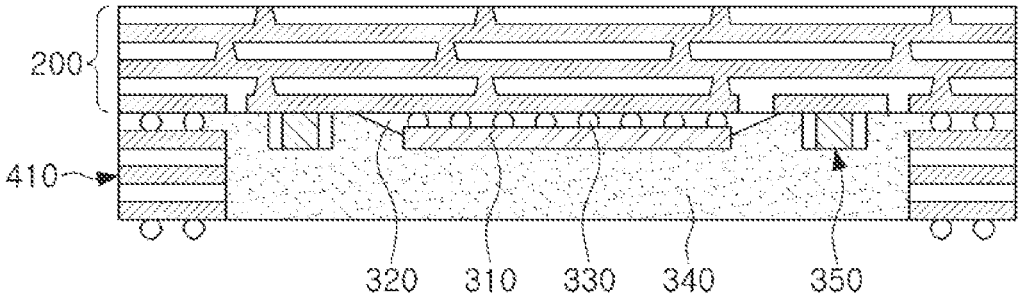
FIGS. 6A and 6B illustrate side vides of examples of a lower structure of a connection member included in an antenna apparatus and an antenna module.
Figure 6B:
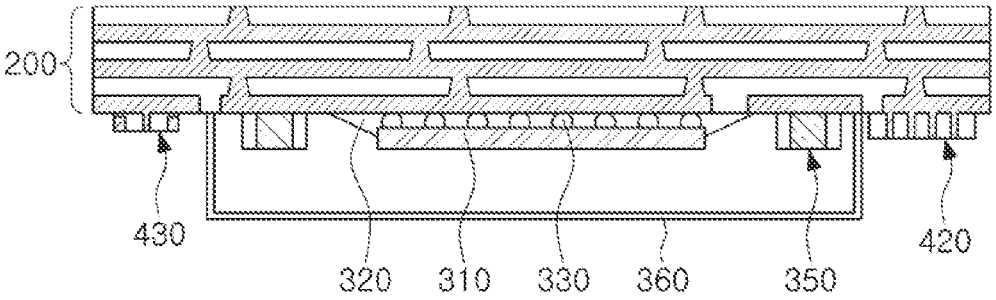

FIGS. 6A and 6B are side views illustrating a lower structure of a connection member included in an antenna apparatus and an antenna module according to an example.

Referring to FIG. 6A, an antenna module according to an example may include at least some of a connection member 200, an IC 310, an adhesive member 320, an electrical connection structure 330, an encapsulant 340, a passive component 350, and a sub-board 410.

The connection member 200 may have a structure similar to the structure of the connection member described above with reference to FIGS. 1 through 5.

The IC 310 may be the same as the IC described above, and may be disposed on a lower side of the connection member 200. The IC 310 may be electrically connected to the wiring of the connection member 200 to transmit or receive an RF signal and may be electrically connected to the ground layer of the connection member 200 to receive a ground. For example, the IC 310 may perform at least some of operations such as frequency conversion, amplification, filtering, phase control, and power generation to produce a converted signal.

The adhesive member 320 may adhere the IC 310 and the connection member 200 to each other.

The electrical connection structure 330 may electrically connect the IC 310 and the connection member 200. For example, the electrical connection structure 330 may have a structure such as a solder ball, a pin, a land, and a pad. The electrical connection structure 330 may have a melting point lower than melting points of the wiring and the ground layer of the connection member 200, and thus, the electrical connection structure 330 may electrically connect the IC 310 and the connection member 200 through a predetermined process using the low melting point.

The encapsulant 340 may encapsulate at least a portion of the IC 310 and improve heat dissipation performance and shock protection performance of the IC 310. For example, the encapsulant 340 may be realized as photo imageable encapsulant (PIE), Ajinomoto build-up film (ABF), an epoxy molding compound (EMC), or similar materials, but is not limited thereto.

The passive component 350 may be disposed on a lower surface of the connection member 200 and may be electrically connected to the wiring and/or the ground layer of the connection member 200 through the electrical connection structure 330. For example, the passive component 350 may include at least some of a capacitor (e.g., multilayer ceramic capacitor (MLCC)), an inductor, and a chip resistor.

The sub-board 410 may be disposed below the connection member 200 and may be electrically connected to the connection member 200 to receive an intermediate frequency (IF) signal or a baseband signal from an external source and transfer the received signal to the IC 310 or receive an IF signal or a baseband signal from the IC 310 and transfer the received signal to the outside. Here, a frequency (e.g., 24 GHz, 28 GHz, 36 GHz, 39 GHz, and 60 GHz) of the RF signal may be higher than a frequency (e.g., 2 GHz, 5 GHz, 10 GHz, etc.) of the IF signal.

For example, the sub-board 410 may transfer or receive an IF signal or a baseband signal to or from the IC 310 through the wiring included in an IC ground layer of the connection member 200. Since the first ground layer of the connection member 200 is disposed between the IC ground layer and the wiring, the IF signal or the baseband signal and the RF signal may be electrically isolated in the antenna module.

Referring to FIG. 6B, an antenna module according to an example may include at least some of a shielding member 360, a connector 420, and a chip antenna 430.

The shielding member 360 may be disposed below the connection member 200 and confine the IC 310 together with the connection member 200. For example, the shielding member 360 may be disposed to cover the IC 310 and the passive component 350 together (e.g., conformal shield) or cover the IC 310 and passive component 350 separately (e.g., compartment shield). For example, the shielding member 360 may have a shape of hexahedron in which one side is open, and may have a hexahedral accommodation space of the hexahedral shape through coupling with the connection member 200. The shielding member 360 may be formed of a material having high conductivity such as copper, may have a short skin depth, and may be electrically connected to the ground layer of the connection member 200. Accordingly, the shielding member 360 may reduce electromagnetic noise that may act on or affect the IC 310 and the passive component 350.

The connector 420 may have a connection structure of a cable (e.g., a coaxial cable, a flexible PCB), may be electrically connected to the IC ground layer of the connection member 200, and may have a role similar to that of the sub-board described above. That is, the connector 420 may be provided with an IF signal, a baseband signal, and/or power from a cable, or may provide an IF signal and/or a baseband signal to the cable. The chip antenna 430 may transmit or receive an RF signal to assist the antenna apparatus according to an example. For example, the chip antenna 430 may include a dielectric block having permittivity higher than the permittivity of the insulating layer and a plurality of electrodes disposed on both sides of the dielectric block. One of the plurality of electrodes may be electrically connected to the wiring of the connection member 200 and the other may be electrically connected to the ground layer of the connection member 200.

Figure 7:
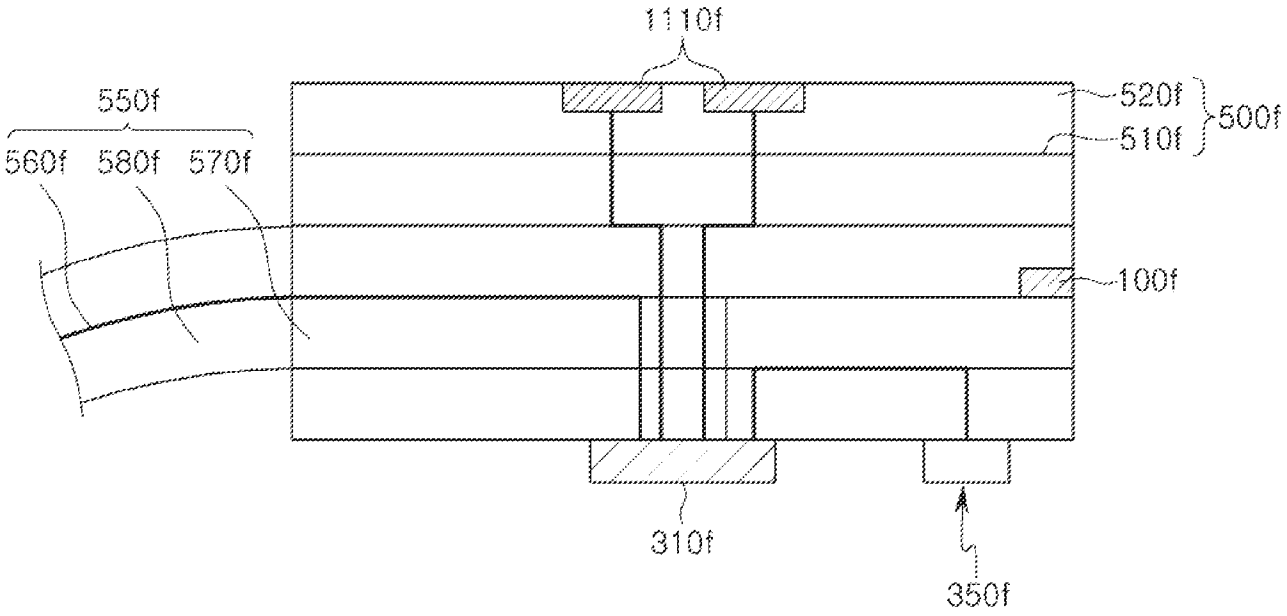
FIG. 7 illustrates a side view of an example of a structure of an antenna apparatus and an antenna module.

FIG. 7 is a side view illustrating an example of a structure of an antenna apparatus and an antenna module.

Referring to FIG. 7, an antenna module according to an example may include an end-fire antenna 100*f*, a patch antenna pattern 1110*f*, an IC 310*f*, and a passive component 350*f* integrated in a connection member 500*f*.

The end-fire antenna 100*f* and the patch antenna pattern 1110*f* may be configured to be the same as the antenna apparatus and the patch antenna pattern described above, and may receive an RF signal from the IC 310*f* and transmit the received RF signal, or transfer a received RF signal to the IC 310*f*.

The connection member 500*f* may have a structure in which at least one conductive layer 510*f* and at least one insulating layer 520*f* are stacked (e.g., a structure of a printed circuit board (PCB)). The conductive layer 510*f* may include the ground layer and the feed line described above.

Additionally, the antenna module according to an example may further include a flexible connection member 550*f*. The flexible connection member 550*f* may include a first flexible region 570*f* overlapping the connection member 500*f* and a second flexible region 580*f* not overlapping the connection member 500*f*, when viewed in the vertical direction.

In an example, second flexible region 580*f* may be bent flexibly in the vertical direction. Accordingly, the second flexible region 580*f* may be flexibly connected to a connector and/or an adjacent antenna module of a set board.

The flexible connection member 550*f* may include a signal line 560*f*. An intermediate frequency (IF) signal and/or baseband signal may be transferred to the IC 310*f* via the signal line 560*f* or to the connector and/or the adjacent antenna module of the set board.

Figure 8A:
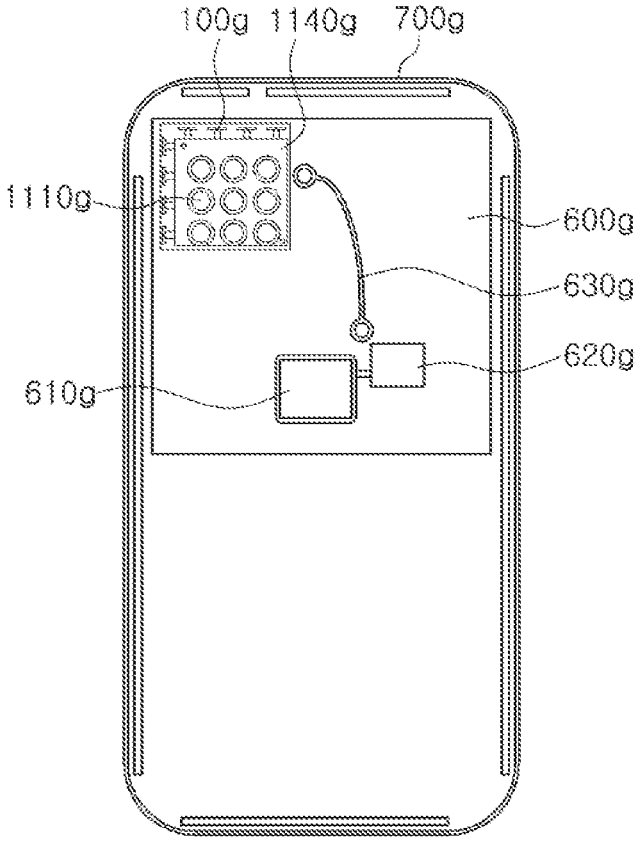
FIGS. 8A and 8B illustrate plan views of examples of an antenna module disposed in an electronic device.
Figure 8B:
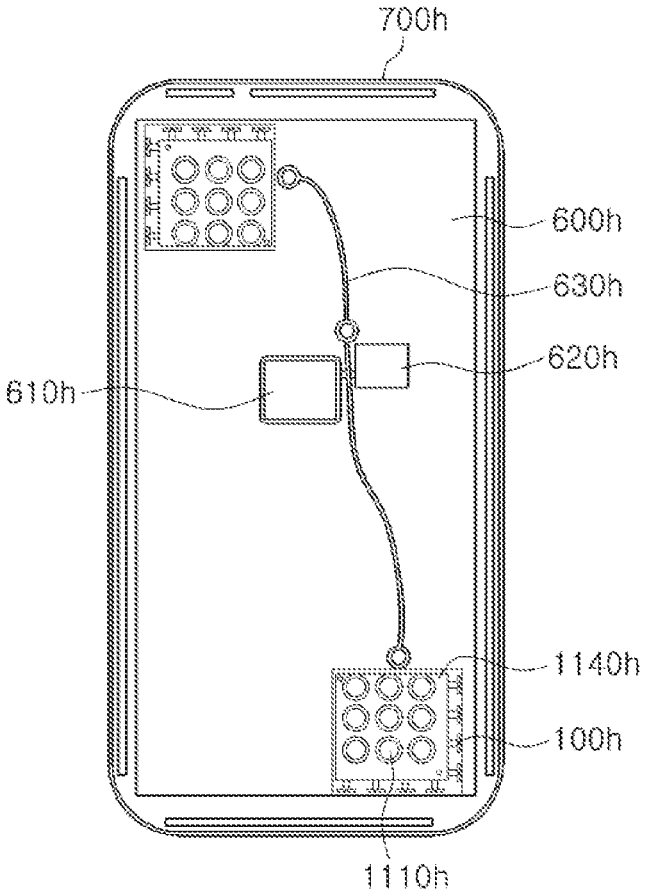

FIGS. 8A and 8B are plan views illustrating examples of an arrangement of antenna modules in an electronic device.

Referring to FIG. 8A, an antenna module including an end-fire antenna 100*g*, a patch antenna pattern 1110*g*, and an insulating layer 1140*g* may be mounted adjacent to a side boundary of an electronic device 700*g* on a set board 600*g* of the electronic device 700*g*.

The electronic device 700*g* may be a smartphone, a personal digital assistant, a digital video camera, a digital still camera, a network system, a computer, a monitor, a tablet, a laptop, a netbook, a television, a video game, a smart watch, an automotive, and similar devices, but is not limited thereto.

A communications module 610*g* and a baseband circuit 620*g* may be further disposed on the set board 600*g*. The antenna module may be electrically coupled to the communications module 610*g* and/or the baseband circuit 620*g* via a coaxial cable 630*g*.

The communications module 610*g* may include at least some of a memory chip such as a volatile memory (e.g., DRAM), a non-volatile memory (e.g., ROM), a flash memory, etc., to perform digital signal processing; an application processor chip, such as a central processor (e.g., CPU), a graphics processor (e.g., GPU), a digital signal processor, an encryption processor, a microprocessor, a micro-controller, and the like; and a logic chip such as an analog-to-digital converter (ADC), an application-specific IC (ASIC), and similar devices.

The baseband circuit 620*g* may perform analog-to-digital conversion and amplification, filtering, and frequency conversion on an analog signal to generate a base signal. The base signal input/output from the baseband circuit 620*g* may be transferred to the antenna module via a cable.

For example, the base signal may be transferred to the IC through an electrical connection structure, a core via, and a wiring. The IC may convert the base signal into an RF signal of a millimeter wave (mmWave) band.

Referring to FIG. 8B, a plurality of antenna modules each including an end-fire antenna 100*h*, a patch antenna pattern 1110*h* and an insulating layer 1140*h* may be mounted adjacent to a first boundary and a second boundary of an electronic device 700*h* on a set board 600*h* of the electronic device 700*h*, and a communications module 610*h* and a baseband circuit 620*h* may be further disposed on the set board 600*h*. The plurality of antenna modules may be electrically connected to the communications module 610*h* and/or the baseband circuit 620*h* via one or more coaxial cables 630*h*.

In an example, the patch antenna pattern, the coupling patch pattern, the conductive array pattern, the conductive ring pattern, the conductive perforated plate pattern, the feed via, the array via, the connection via, the grounding via, the shielding via, the ground layer, the end-fire antenna pattern, the director pattern, the coupling ground pattern, and the electrical connection structure described in this disclosure may include a metal (e.g., a conductive material such as copper (Cu), aluminum (Al), silver (Ag), tin (Sn), gold (Au), nickel (Ni), lead (Pb), titanium (Ti), or an alloy thereof) and may be formed through a plating method such as chemical vapor deposition (CVD), physical vapor deposition (PVD), sputtering, subtractive, additive, semi-additive process (SAP), a modified semi-additive process (MSAP), and the like, but is not limited thereto.

In an example, the insulating layer described in this disclosure may be formed of a thermosetting resin such as FR4, liquid crystal polymer (LCP), low temperature co-fired ceramic (LTCC), a resin such as a thermoplastic resin such as an epoxy resin, a thermoplastic resin such as polyimide, a resin obtained by impregnating these resins in a core of glass fiber, glass cloth, glass fabric, and the like, together with an inorganic filler, prepreg, Ajinomoto build-up film (ABF), FR-4, bismaleimide triazine (BT), photo imageable dielectric (PID) resin, general copper clad laminate (CCL), or glass or ceramic-based insulator, and the like. The insulating layer may fill at least a portion of a position where the patch antenna pattern, the coupling patch pattern, the conductive array pattern, the conductive ring pattern, the conductive perforated plate pattern, the feed via, the array via, the connection via, the grounding via, the shielding via, the ground layer, the end-fire antenna pattern, the director pattern, the coupling ground pattern, and the electrical connection structure are not disposed in the antenna apparatus and the antenna module described in this disclosure.

In an example, the RF signals described in this disclosure may have a form such as Wi-Fi (IEEE 802.11 family, etc.), WiMAX (IEEE 802.16 family, etc.), IEEE 802.20, long term evolution (LTE), Ev-DO, HSPA+, HSDPA+, HSUPA+, EDGE, GSM, GPS, GPRS, CDMA, TDMA, DECT, Bluetooth, 3G, 4G, 5G and a following one in accordance with certain designated wireless and wired protocols, but is not limited thereto.

As set forth above, the antenna apparatus and the antenna module according to the various examples may further concentrate the RF signal in the Z direction, having improved antenna performance.

The antenna apparatus and the antenna module according to the examples may improve electromagnetic isolation with respect to an adjacent antenna apparatus by reducing the phenomenon that the RF signal leaks to the adjacent antenna apparatus, and may have a reduced size by being disposed to be closer to the adjacent antenna apparatus or by omitting a separate component for electromagnetic shielding.

The antenna apparatus and the antenna module according to the various examples may improve electromagnetic isolation between the patch antenna and the end-fire antenna and have a reduced size, while extending an RF signal transmission/reception direction.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus comprising:

a ground layer;

first and second patch antenna patterns disposed above the ground layer;

grounding vias extended from the ground layer in an upward direction and disposed between the first and second patch antenna patterns in view of a vertical direction;

first-side conductive array patterns above the ground layer and disposed between the first patch antenna pattern and the grounding vias; and second-side conductive array patterns above the ground layer and disposed between the second patch antenna pattern and the grounding vias, wherein the first-side conductive array patterns and the second-side conductive array patterns are electrically separated from the ground layer.

2. The antenna apparatus of claim 1, wherein:

each of the first-side conductive array patterns and a portion of the ground layer form a shape of a capacitor, and each of the second-side conductive array patterns and a portion of the ground layer form a shape of a capacitor.

3. The antenna apparatus of claim 1, wherein:

a number of the first-side conductive array patterns disposed between the first patch antenna pattern and the grounding vias is three or more, and a number of the second-side conductive array patterns disposed between the second patch antenna pattern and the grounding vias is three or more.

4. The antenna apparatus of claim 1, wherein:

the first-side conductive array patterns disposed between the first patch antenna pattern and the grounding vias are arranged to surround the first patch antenna pattern, and the second-side conductive array patterns disposed between the second patch antenna pattern and the grounding vias are arranged to surround the second patch antenna pattern.

5. The antenna apparatus of claim 1, wherein:

the first-side conductive array patterns have a same shape, and are spaced apart from each other, the second-side conductive array patterns have a same shape, and are spaced apart from each other, an interval between each of the first-side conductive array patterns is shorter than an interval between the first-side conductive array patterns and the first patch antenna pattern, and an interval between each of the second-side conductive array patterns is shorter than an interval between the second-side conductive array patterns and the second patch antenna pattern.

6. The antenna apparatus of claim 1, wherein:

a first group of the first-side conductive array patterns is disposed above or below a second group of the first-side conductive array patterns, and a first group of the second-side conductive array patterns is disposed above or below a second group of the second-side conductive array patterns.

7. The antenna apparatus of claim 6, further comprising:

first-side array vias disposed between the first and second groups of the first-side conductive array patterns; and second-side array vias disposed between the first and second groups of the second-side conductive array patterns.

8. The antenna apparatus of claim 6, further comprising first and second coupling patch patterns disposed above the first and second patch antenna patterns.

9. The antenna apparatus of claim 1, further comprising a first conductive plate pattern disposed on the grounding vias and electrically connected to the grounding vias, wherein at least a portion of the first conductive plate pattern is disposed between the first-side conductive array patterns and the second-side conductive array patterns in view of a vertical direction.

10. The antenna apparatus of claim 9, wherein the first conductive plate pattern has a ring shape and/or a perforated plate shape.

11. The antenna apparatus of claim 9, further comprising:

a second conductive plate pattern disposed above the first conductive plate pattern; and connection vias electrically connected between the first and second conductive plate patterns and disposed between the first-side conductive array patterns and the second-side conductive array patterns in view of a vertical direction.

12. The antenna apparatus of claim 1, further comprising first and second feed vias, wherein the ground layer has first and second through-holes in which the first and second feed vias are respectively disposed.

13. The antenna apparatus of claim 1, wherein an upper first-side conductive array pattern of the first-side conductive array patterns is disposed on a same first level as the first antenna pattern from the ground layer, and wherein an upper second-side conductive array pattern of the second-side conductive array patterns is disposed on a same second level as the second antenna pattern from the ground layer.

* * * * *